US006138727A

United States Patent [19]

Shih

[11] Patent Number: 6,138,727

[45] Date of Patent: Oct. 31, 2000

[54] PUTTER COVER KIT

[76] Inventor: Arthur Tseshao Shih, 2443 Seaman Ave., South El Monte, Calif. 91733

[21] Appl. No.: 09/296,881

[22] Filed: Apr. 22, 1999

[51] Int. Cl.[7] ..... A63B 57/00

[52] U.S. Cl. ..... 150/160; 206/315.2; 15/209.1

[58] Field of Search ..... 150/160; 206/315.2, 206/315.4; 15/209.1

[56] References Cited

U.S. PATENT DOCUMENTS

| | | | |
|---|---|---|---|
| 3,603,368 | 9/1971 | Brenner | 150/160 |
| 3,638,284 | 2/1972 | Baker | 150/160 X |
| 4,119,129 | 10/1978 | Freiberg | 150/160 |
| 4,263,950 | 4/1981 | Brown | 206/315.6 |
| 4,898,222 | 2/1990 | Gaffney | 150/160 |
| 5,322,105 | 6/1994 | Meek | 150/160 |
| 5,816,396 | 10/1998 | Shin | 206/315.2 X |

FOREIGN PATENT DOCUMENTS

| | | | |
|---|---|---|---|
| 974912 | 11/1964 | United Kingdom | 150/160 |

*Primary Examiner*—Sue A. Weaver
*Attorney, Agent, or Firm*—Raymond Y. Chan; A. Justin Lum; David and Raymond

[57] ABSTRACT

A putter cover kit comprises a detachable towel connecting to a putter cover, which has a protective bag with an opening for the head of a putter, a receiving and an attaching means. Said receiving means integrally affixed to said putter cover and said attaching means integrally affixed to said towel. Said attaching means on said putter towel detachably connecting with said receiving means on said putter cover so as to detachably attach said putter towel to said putter cover.

4 Claims, 5 Drawing Sheets

PUTTER COVER KIT

FIELD OF THE PRESENT INVENTION

The present invention relates to putter covers, and more particularly, to a putter cover kit that provides a golfer not only with a cover for enclosing the putter when not in use, but also provides a detachable towel for cleaning a ball on the green before putting, and for cleaning the putter immediately after use, without having to separately carry a towel.

BACKGROUND OF THE PRESENT INVENTION

The sport of golf consists of hitting a golf ball from a starting point, commonly known as a "tee box," to a hole, which is surrounded by an island of short, clipped grass, commonly called a "green." A golfer uses golf clubs to play the game, one of which is a putter. The putter is typically used when the golf ball is on the green, and is used to putt the golf ball into the hole. A "putt" is when a golfer hits the golf ball with the putter causing it to roll into the hole. There is a familiar saying in golf, "drive for show, putt for dough." In other words, putting is one of the most important parts of any golfer's game. As a result, the putter is one of the most important golf clubs in a golfer's golf bag. Because of its importance, a golfer can be fanatical about keeping his or her putter clean. A golfer keeps his or her putter clean by keeping it covered when not in use, and preferably cleaning it with a towel after each use before again putting it back in the cover.

Similarly, the golf ball is just as important to putting. Once a golfer starts from a tee box, normally, the golfer may not touch the ball once the golfer has hit the first shot, regardless if the golf ball is caked with mud, touching a branch, or affected by any other impediment that might affect it's flight. Once the ball has landed on the green, however, the golfer may pick up the ball from the green, clean any debris from the ball, and then place the golf ball back in the same location and putt the golf ball into the hole. It is important that the golf ball be clean to ensure that the golf ball rolls in the direction it is putted. Golfers are therefore just as fanatical about cleaning a golf ball once the ball reaches the green, as they are about keeping the putter head clean.

A golfer carries his or her clubs in a golf bag, and may walk or use a golf cart to make his or her way around the golf course. Conventionally, a towel is attached to the golf bag for cleaning golf clubs and golf balls. The problem with this constant need to clean the putter and the golf ball is that a golfer often does not have the time to return to his or her golf bag, or golf cart, to retrieve a towel to clean the putter or the golf ball. A day of golf may take up to six hours to complete. It is sometimes inconvenient, or a waste of time for a golfer to return to the golf bag after each shot. Often, the layout of the course is such that a golfer must or may choose to leave his or her golf cart and/or golf bag some distance from the green. Or, the golfer may be required to hit from near the green such that it is inconvenient for him or her to return to his or her golf bag before proceeding to the green to putt, taking the putter with him or her while leaving the golf bag at the next tee box. So, in the interest of saving time, a golfer must carry a towel with him or her, if he or she wishes to keep the putter and the golf ball clean once the golfer hits the golf ball onto the green.

Conventionally, this requires a golfer to separately carry a towel with him or her to the green. Some golfers put the towel in their pockets. Some golfers do not have pockets to carry the towel, and must carry it separately. Some golfers also like to carry a wet towel. This means the golfer may be forced to carry a wet towel in his or her hand, or in his or her pocket. If the golfer forgets the towel, he or she may not have time to retrieve a towel from his or her golf bag or the golf cart before proceeding to the green and be forced to putt his or her golf ball without cleaning it, thereby ruining his or her putt or putts on that hole.

The present invention allows a golfer to retain his or her desire to keep his or her putter and golf ball clean, while allowing him or her to avoid having to remember to bring a towel, or to have to carry a towel, wet or dry, separately or in his or her pocket. The present invention has the properties of a simple structure which is easy to manufacture, is of low cost, and satisfies a long felt need in the market.

SUMMARY OF THE PRESENT INVENTION

The main object of the present invention is to provide a putter cover kit that provides a cover for a putter and a detachable towel for cleaning the putter and golf balls, thereby allowing the golfer to clean his or her putter and golf ball without having to return to the golf bag to retrieve a towel to clean the putter or the golf balls.

Another object of the present invention is to provide a putter cover kit that provides a detachable towel that does not have to be carried separately from the putter cover of the putter cover kit.

A further object of the present invention is to provide a putter cover comprising a detachable towel that may also be used to clean other clubs used by a golfer when the golfer is near a green without requiring said golfer to return to his or her golf bag to clean his or her golf club before putting.

Accordingly, in order to accomplish the above objects, the present invention provides a preferred embodiment of a putter cover kit which comprises a putter cover, a receiving means comprising a loop fastener integrally connecting to an outer surface of the putter cover, a towel, and an attaching means comprising a hook fastener integrally connecting to the towel for attaching the towel to the putter cover by the receiving means, such that the towel can be selectively attached and detached from the putter cover.

In another embodiment, the receiving means comprises a receiving portion of a snap button system, and the attaching means comprises a snap button portion of a snap button system for allowing said towel to be selectively attached and detached from the putter cover.

In a third embodiment, the putter cover kit comprises a receiving means and an attaching means. The attaching means is integrally connected to a towel. The receiving means has two opposing surfaces, one surface for attaching to said attaching means and the opposing surface having a connecting means for permanent attachment to a putter cover.

In a fourth embodiment of the putter cover kit, the putter cover kit comprises a putter cover having an outer surface made of said looping material, an attaching means comprised of said fastening material for attaching to the outer surface of the putter cover, and a towel integrally connecting to the attaching means.

DETAILED DESCRIPTION OF THE PREFERRED EMBODIMENT

Figure 1:
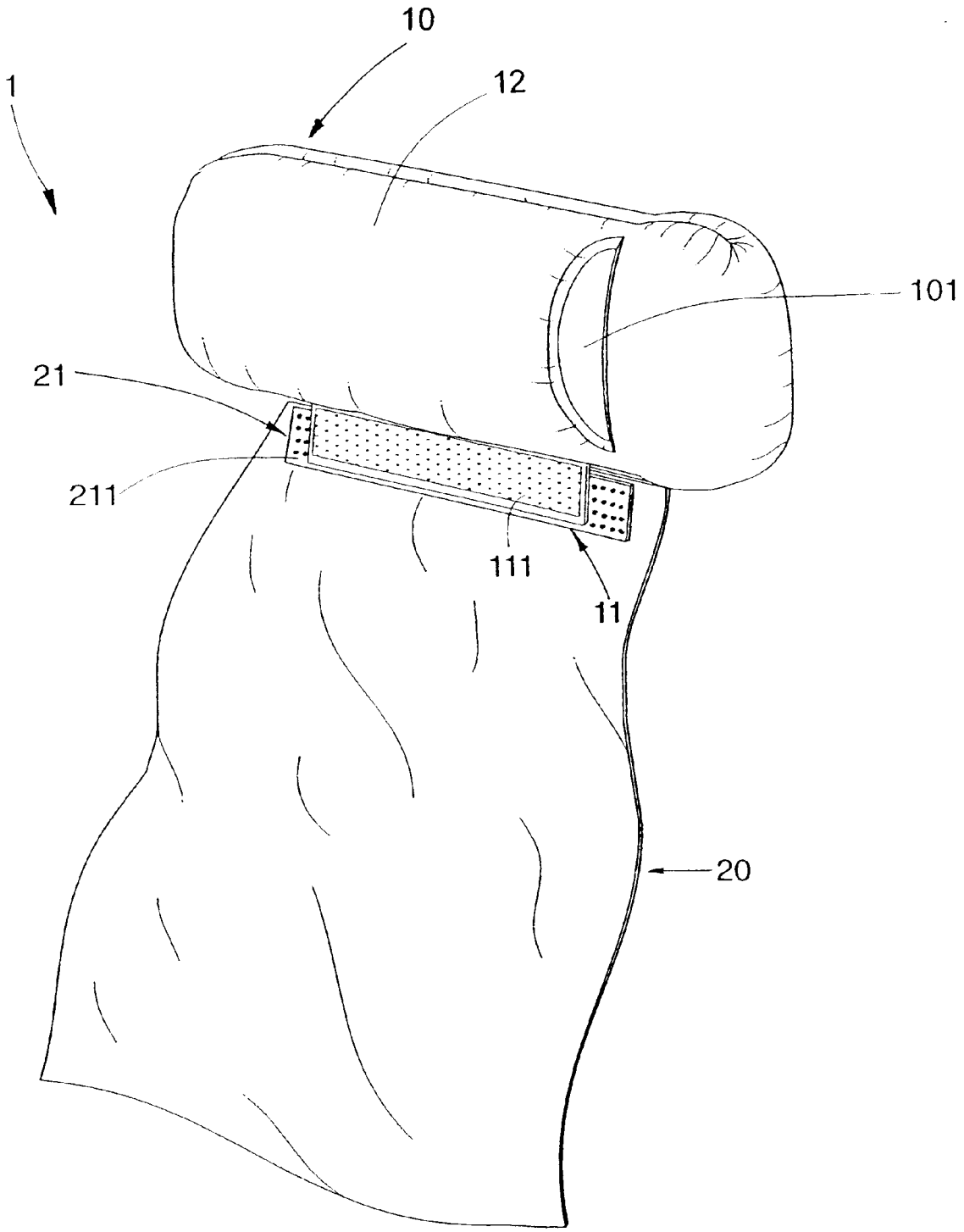
FIG. 1 is a perspective view of a putter having a towel attached to a putter cover according to a first preferred embodiment of the present invention.

Referring to FIGS. 1 to 5 of the drawings, a putter cover kit 1 of the present invention comprises a putter cover 10 which includes a protective bag having an opening 101 provided thereon for receiving a putter head 41 therein, a receiving means 11 integrally affixed to an outer surface 12 of the putter cover 10, a putter towel 20 being large enough to clean the putter head 41 and a golf ball, and an attaching means 21 integrally connected to a the putter towel 20. The putter cover 10 is made of foam sheet material, such as Neoprene, SBR or rubber, having both surfaces coated with fabric like nylon jersey knit, plush or cotton.

Figure 2:
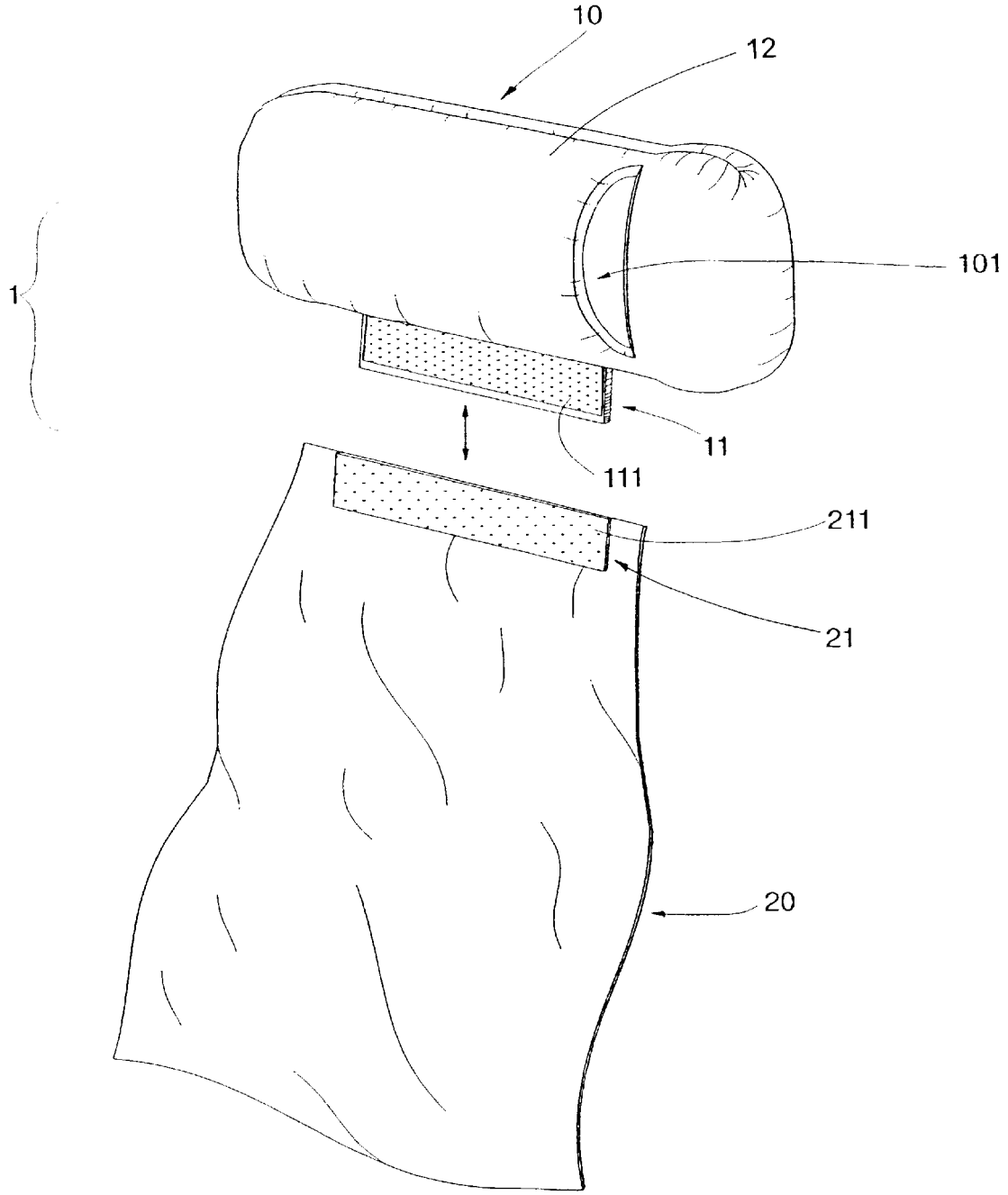
FIG. 2 is a second perspective view of the putter cover kit having the towel detached from the putter cover according to the above first preferred embodiment of the present invention.
Figure 3:
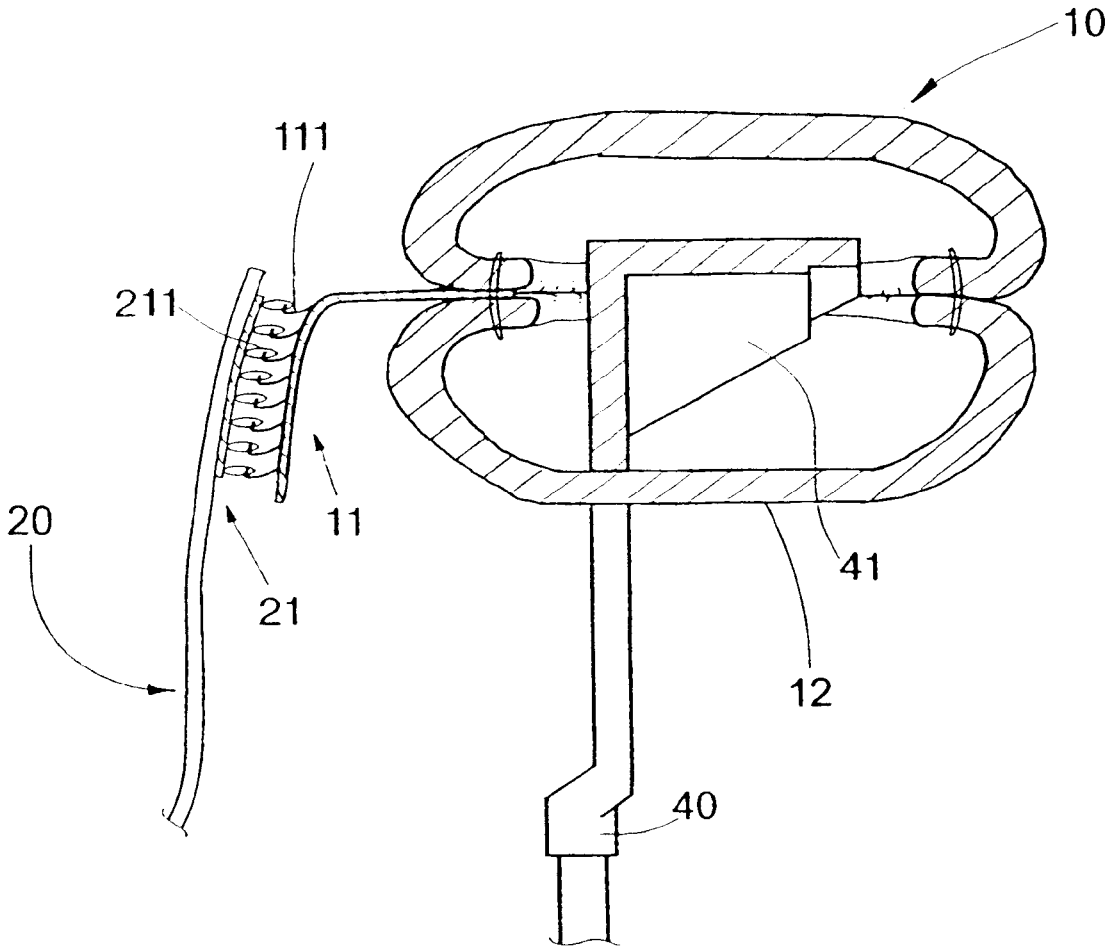
FIG. 3 is a cross sectional view of a putter cover kit according to the above first preferred embodiment of the present invention.

Referring to FIGS. 1, 2 and 3, according to a first preferred embodiment, the receiving means 11 comprises a strip of loop fastener 111 having a length shorter than that of the putter cover 10. The loop fastener 11 is connected to the putter cover 10 by sewing a top side of the loop fastener 111 to a bottom side of the putter cover 10. The attaching means 21 comprises a hook fastener 211 sewn to a top side of the putter towel 20, so that the putter towel 20 can be attached to the putter cover 10 by fixedly attaching the hook fastener 211 of the attaching means 21 to the loop fastener 111 of the receiving means 11, i.e. by means of the connection between the hooks and loops provided on the loop and hook fasteners 111, 211 respectively. The putter towel 20 can also be detached from the putter cover 10 by detaching the receiving means 11 from the attaching means 21, i.e. simply by pulling the putter towel 20 from the putter cover 10 so as to separate the connection between the hooks and loops provided on the loop and hook fasteners 111, 211.

As shown in FIG. 3, the putter cover 10 covers the putter head 41 of a putter 40 when the putter head 41 is placed in the putter cover 10.

Normally, the putter cover 10 is supposed to be covering the putter head 41 of the putter 40 that is stored and carried in a golf bag. The putter towel 20 is firmly attached to the putter cover 10 by means of the detachable connection between the receiving means 11 and the attaching means 21. In other words, the putter towel 20 is carried with the putter cover 10 together. Since the golfer may not place the golf bag on the green or drive the golf cart on or around the green, the golfer must merely carry the putter 40 to the green for putting. The golfer may either take the putter 40 with the putter cover 10 covered thereon, or alternatively uncover the putter 40 and detach the putter towel 20 from the putter cover 10 so that the golfer may take both the putter 40 and the putter towel 20 to the green.

On the way to the green, the golfer may finally clean the putter head 41 with the putter towel 20 for better putting contact. On the green, the golfer may use the putter towel 20 to clean the golf ball too. After the putting and on the way back to the golf bag or golf cart, the golfer can clean the putter head 41 again before it is placed back in the putter cover 10. The golfer neither will have any headache of where to place the towel nor needs to carry the wet towel in pocket. The golfer can simply re-attach the putter towel 20 to the putter cover 10, which is covered on the putter head 41, by attaching the hook fastener 211 of the attaching means 21 on the putter towel 20 to the loop fastener 111 of the receiving means 11 on the putter cover 10.

One appreciates that no unnecessary complicated element or configuration is involved in the present invention, so that all golfers can affordably solve their number one headache of cleaning the putter and golf ball before and after putting. Golfers no longer need carry a wet towel with them anymore, which normally may cause a great deal of inconvenience. The putter cover 10 is the excellent component for a small piece of putter towel attaching thereto. In fact, nobody who is skilled in this art has suggested: (1) the use of a small piece of putter towel, for example 5 inches×10 inches, that is designed large enough to clean the putter head 41 or other club heads and the golf ball; and (2) the attachment of the putter towel 20 with the putter cover 10, that is the most convenience and economical way to solve the conventional problems.

It is an obvious modification in view of the above first preferred embodiment that, the loop fastener 111 of the receiving means 11 may alternatively be substituted by the hook fastener 211 and the attaching means 21 may alternatively comprise the loop fastener 11 instead of the hook fastener 211 as shown in FIGS. 1 to 3.

Figure 4:
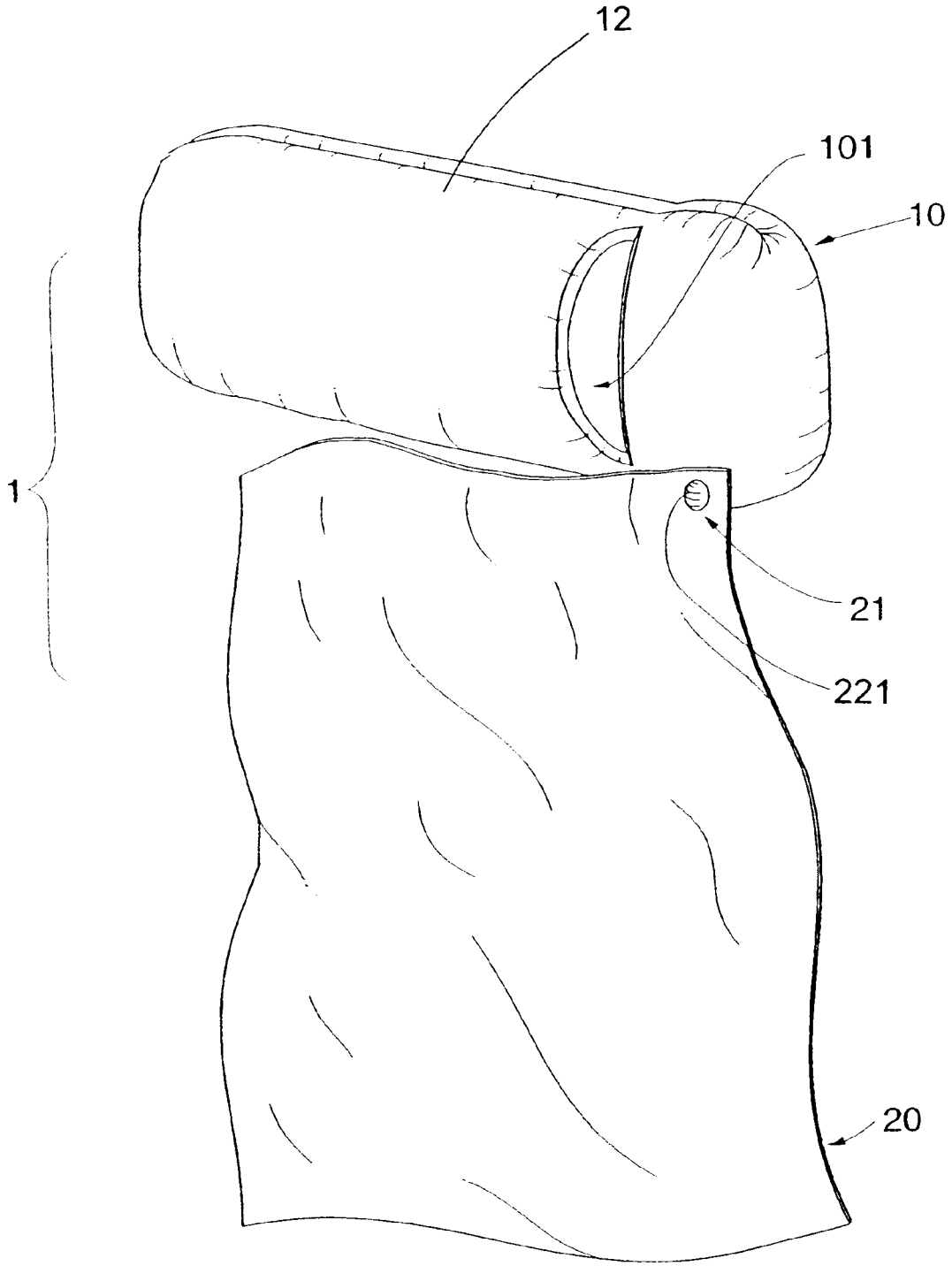
FIG. 4 is a perspective view of a putter cover kit having a towel attached to a putter cover according to a second preferred embodiment of the present invention.
Figure 5:
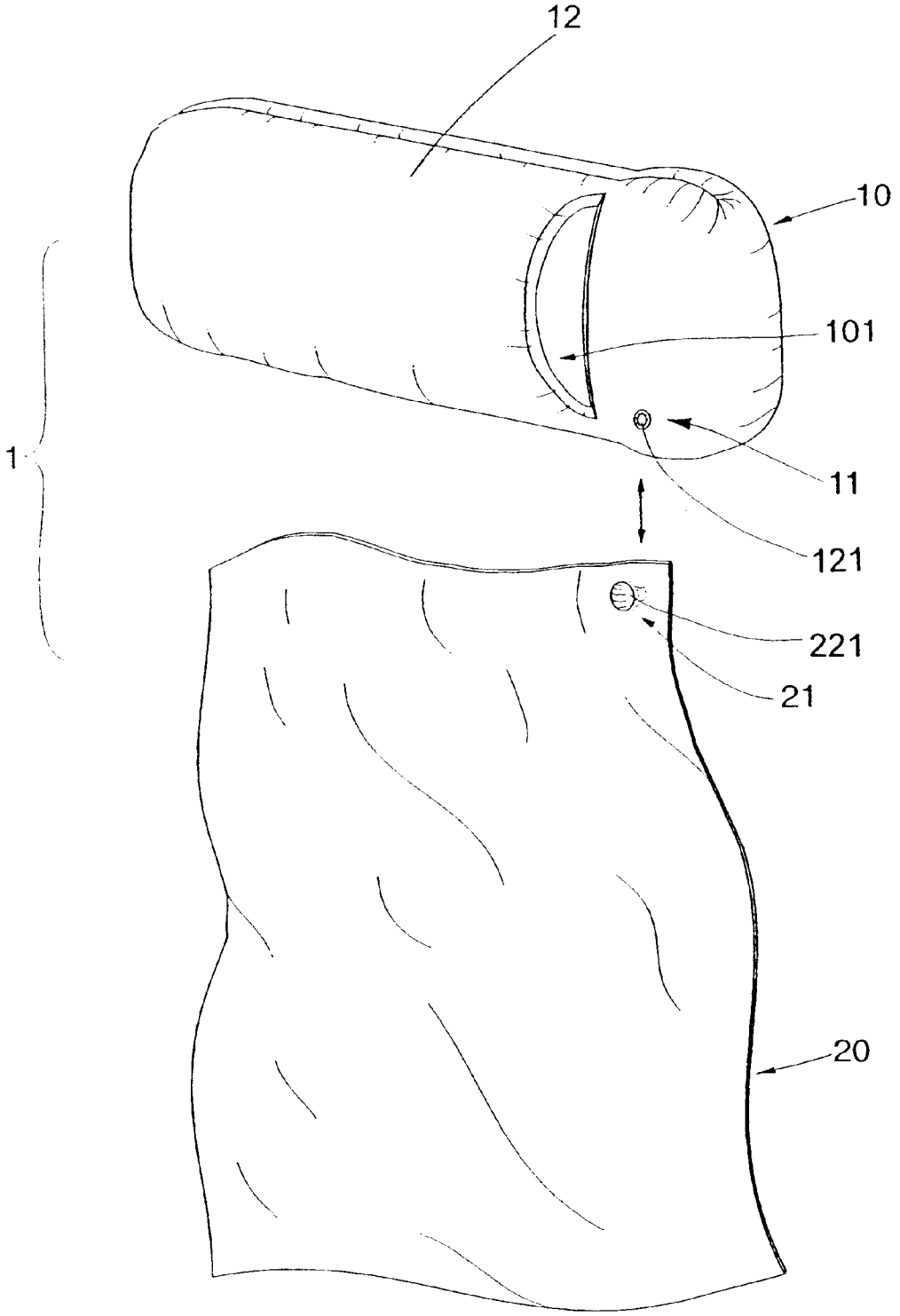
FIG. 5 is a perspective view of the putter cover kit having the towel attached to the putter cover according to the above second preferred embodiment of the present invention.

Referring to FIGS. 4 and 5, a second preferred embodiment, which is an alternative mode of the above first preferred embodiment, is illustrated, wherein a set of button fasteners including a button socket 121 and a button plug 221 is used to substitute the loop and hook fasteners 111, 211, wherein the receiving means 11 comprises a button socket 121 affixed on a corner position of the putter cover 10, and the attachable means 21 comprises a button plug 221 affixed on a corner position of the putter towel 20 for detachably connecting with the button socket 121 so as to attach the putter towel 20 to the putter cover 10 when it is not in use.

Again, it is an obvious modification to exchange the positions of the button socket 121 and the button plug 221, that is to affix the button socket 121 on the putter towel 20 and to affix the button plug 21*a* on the putter cover 10. The modified mode will work the same as the second embodiment described above.

An alternative mode of the above first preferred embodiment that the loop fastener 111 of the receiving means 11 may alternatively cover the entire surface area of the outer surface of the putter cover 10 so as to allow the putter towel 20 to attach to the putter cover 10 anywhere on the outer surface of the putter cover 10.

What is claimed is:

1. A putter cover kit, comprising:

a putter cover which includes a protective bag having an opening provided thereon for receiving a putter head of a putter therein;

a receiving means integrally provided on an outer surface of said putter cover;

a putter towel being large enough for cleaning said putter head and a golf ball; and an attaching means integrally affixed on said putter towel for detachably connecting with said receiving means so as to detachably attach said putter towel to said putter cover;

wherein said receiving means further comprises a strip of loop fastener having a length shorter than that of said putter cover, said loop fastener is connected to said putter cover;

wherein said attaching means further comprises a hook fastener connected to said putter towel, so as to enable said putter towel being attached to said putter cover by fixedly attaching said hook fastener of said attaching means to said loop fastener of said receiving means.

2. A putter cover kit, as recited in claim 1, wherein a top side of said loop fastener is sewn to a bottom side of said putter cover and said hook fastener is sewn to a top side of said putter towel.

3. A putter cover kit, comprising:

a putter cover which includes a protective bag having an opening provided thereon for receiving a putter head of a putter therein;

a receiving means integrally provided on an outer surface of said putter cover;

a putter towel being large enough for cleaning said putter head and a golf ball; and an attaching means integrally affixed on said putter towel for detachably connecting with said receiving means so as to detachably attach said putter towel to said putter cover;

wherein said receiving means further comprises a strip of hook fastener having a length shorter than that of said putter cover, said hook fastener is connected to said putter cover;

wherein said attaching means further comprises a strip of loop fastener connected to said putter towel, so as to enable said putter towel to be attached to said putter cover by detachably attaching said loop fastener of said attaching means to said hook fastener of said receiving means.

4. A putter cover kit, as recited in claim 3, wherein a top side of said hook fastener is sewn to a bottom side of said putter cover, and said loop fastener is sewn to a top side of said putter towel.

* * * * *